US006918745B2

(12) United States Patent
Caron et al.

(10) Patent No.: US 6,918,745 B2
(45) Date of Patent: Jul. 19, 2005

(54) GAS TURBINE ENGINE AXIAL STATOR COMPRESSOR

(75) Inventors: Stéphane Caron, Boussy Saint-Antoine (FR); Pierre Debeneix, Saint-Sauveur/Ecole (FR); Philippe Guerout, Le Chatelet (FR)

(73) Assignee: SNECMA Moteurs, Paris (FR)

( * ) Notice: Subject to any disclaimer, the term of this patent is extended or adjusted under 35 U.S.C. 154(b) by 23 days.

(21) Appl. No.: 10/451,626

(22) PCT Filed: Jan. 3, 2002

(86) PCT No.: PCT/FR02/00007

§ 371 (c)(1),
(2), (4) Date: Dec. 9, 2003

(87) PCT Pub. No.: WO02/053918

PCT Pub. Date: Jul. 11, 2002

(65) Prior Publication Data

US 2004/0086382 A1 May 6, 2004

(30) Foreign Application Priority Data

Jan. 4, 2001 (FR) ..... 01 00060

(51) Int. Cl.[7] ..... F01D 9/04

(52) U.S. Cl. ..... 415/189; 415/191; 415/209.2

(58) Field of Search ..... 415/177, 178, 415/189, 191, 209.2, 211.2

(56) References Cited

U.S. PATENT DOCUMENTS 3,365,173 A * 1/1968 Lynch et al. ..... 415/209.3
4,063,847 A * 12/1977 Simmons ..... 415/200
5,083,900 A * 1/1992 Carletti et al. ..... 415/209.3

* cited by examiner

*Primary Examiner*—Ninh H. Nguyen
(74) *Attorney, Agent, or Firm*—Bacon & Thomas PLLC

(57) ABSTRACT

The invention relates to an axial compressor stator for a gas turbine, the stator having a rigid, external, annular frame and axially juxtaposed rings configured within the frame and bearing annuli of stationary vanes. The rings are defined by arcuate segments affixed to the frame. The inside walls of the arcuate segments externally define the aerodynamic conduit for the compressed gaseous fluid. The arcuate segments are brazed segments that include a honeycomb component sandwiched between an inner sheetmetal bounding the aerodynamic conduit and an outer sheetmetal. The outer sheetmetal solely connects the arcuate segments to the frame.

5 Claims, 2 Drawing Sheets

GAS TURBINE ENGINE AXIAL STATOR COMPRESSOR

BACKGROUND OF THE INVENTION

The present invention relates to gas turbine compressors and in particular to turbojet engine compressors.

More specifically, it relates to an axial compressor stator comprising a rigid, external annular frame and axially juxtaposed rings which are configured radially inside the frame and which support stationary annuli of vanes running radially inward, these annuli including arcuate segments affixed to the frame by appropriate fastening means and externally defining the compressed-gasses' aerodynamic conduit.

In general the arcuate segments comprise an inside wall bounding the aerodynamic conduit and radial ribs pointing outward and resting against the external annular frame, the ribs configured with bases to affix by means of bolts the arcuate segments on the frame. The stationary vanes are affixed in an orifice in the inner wall.

The compressed gases of a turbojet engine high-pressure compressor are hot. The inside walls of the arcuate segments are in direct contact with the hot gases and therefore expand, providing additional play between rotor and stator. Conductive heat transfer by means of the ribs and bolts takes place between the inside wall and the annular frame. The rise in frame temperature entails an increase in displacement directly affecting the play between rotor and stator. The conventional remedy includes cooling the assembly by tapping a cooler gas flow from a region upstream of the compressor, which results, however, in an overall degradation of gas turbine engine efficiency.

SUMMARY OF THE INVENTION

Accordingly and in a first goal, the present invention proposes a compressor stator wherein the heat transfer between aerodynamic flow conduit and the frame is substantially reduced.

The second goal of the present invention is a compressor stator providing improved dynamic behavior of the arcuate segments.

The present invention attains these goals in that the arcuate segments are brazed segments defined by a honeycomb component sandwiched between an outer sheetmetal and an inner sheetmetal bounding the aerodynamic conduit, and in that the connection to the frame is implemented solely by the outer sheetmetal.

Due to this geometry, heat conduction is lowered because the connection between the hot inner sheetmetal and the outer sheetmetal is implemented uniquely by the honeycomb component which restricts the size of the thermally conducting and contacting surfaces between the hot inside and the cold outside. The temperature of the outer sheetmetal is substantially lower than that of the inner sheetmetal. This is even more the case for the external annular frame. Since the brazed arcuate segments provide a good seal, the air flow in the cavities between the outer and inner sheetmetals is restricted, and, as a result, convective heat loss is decreased.

The airflow which must be tapped upstream to cool the rigid, annular frame may be considerably lowered relative to that of the present state of the art.

Advantageously the outer sheetmetal is affixed by bolts to the frame. Preferably, the outer sheetmetal is affixed by a plurality of bolts at its downstream end to the frame and at its upstream end.

This rigid affixation both improves the dynamic behavior of the arcuate segments and permits the inner sheetmetal to expand freely. Consequently, the leakage between upstream and downstream is reduced and compressor efficiency is increased.

In another feature of the present invention, the stationary vanes are imbedded both in the inner and in the outer sheetmetals.

These two sheetmetals are rigidly connected to each other by means of the brazed honeycomb component and they are sufficiently apart from each other to restrict embedding stresses and to improve vane assembly shock absorption.

The honeycomb arcuate segments allow reducing stray leakage between downstream and upstream, resulting in higher compressor efficiency.

Moreover the design is simplified because there no longer is a need to install additional sealing elements between the cavities and the arcuate segments.

Other advantages and features of the present invention are elucidated in the illustrative description below and in relation to the attached drawings.

DETAILED DESCRIPTION OF THE INVENTION

Figure 1:
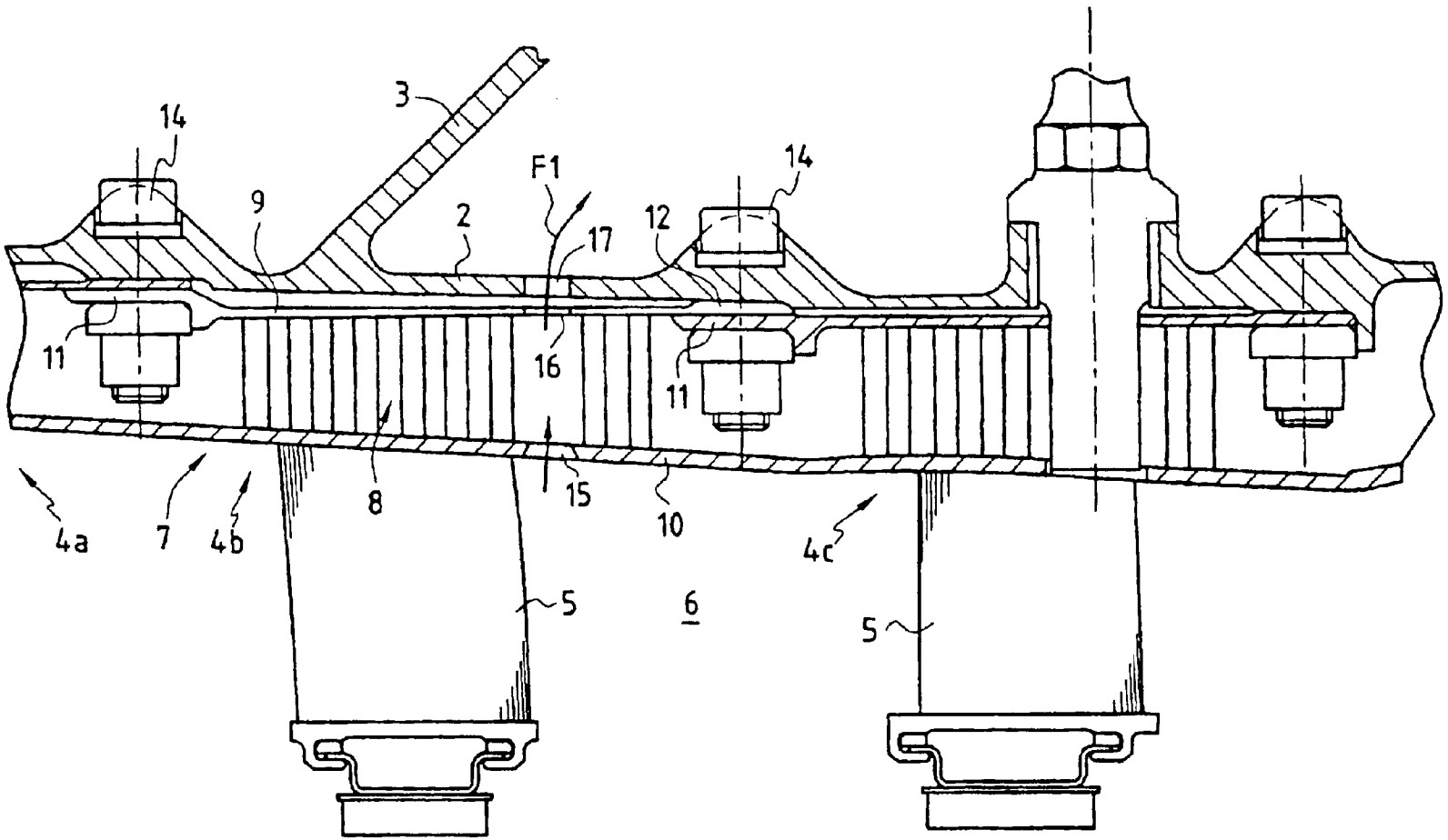
FIG. 1 is a cross-sectional view of a turbojet engine compressor stator of the invention in a plane along the axis of rotation.

FIG. 1 shows a portion of a turbojet-engine compressor stator which, inside an external casing defining within it a cold-air flow path, contains a rigid annular structure 2 that is connected by frustoconical walls 3 to the external casing, furthermore a plurality of axially juxtaposed rings 4*a*, 4*b*, 4*c* that are concentrically configured inside the annular structure 2. Each ring supports an annulus of stationary vanes 5 running radially inward. An omitted rotor flange is fitted with annuli of moving blades and is configured coaxially inside the rings 4*a*, 4*b*, 4*c*, the annuli of moving blades alternating axially with the annuli of stationary vanes in the flowpath 6 of the gas compressed by the compressor.

To mount the stator around the rotor, each ring consists of a plurality of circumferentially juxtaposed arcuate segments 7.

Figure 2:
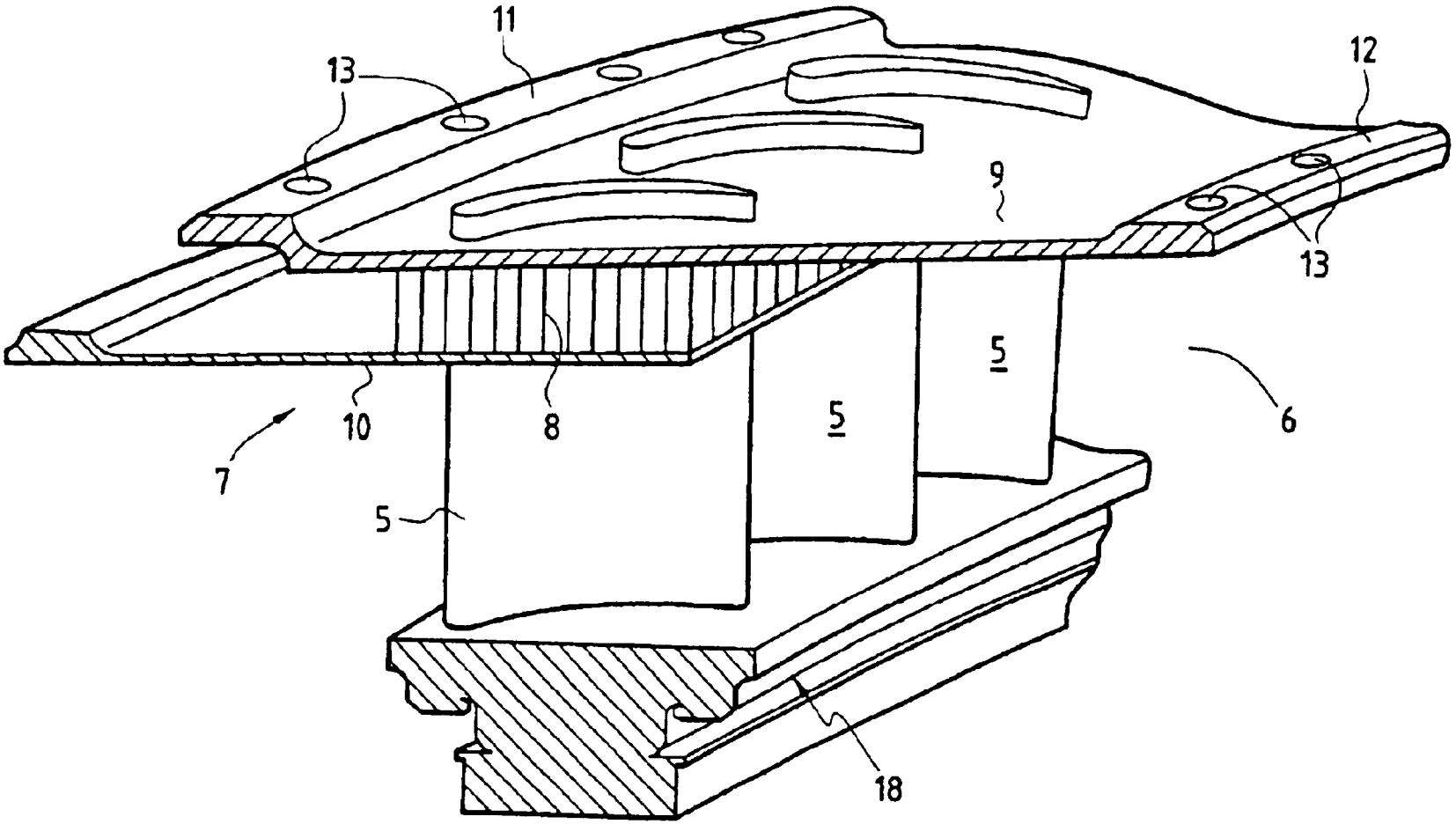
FIG. 2 is a perspective view of an arcuate stator segment of the present invention.

According to the invention and as shown in FIGS. 1 and 2, each arcuate segment 7 consists of a honeycomb component 8 sandwiched between an outer sheetmetal 9 and an inner sheetmetal 10. The outer sheetmetal 9 is fitted at its upstream and downstream ends 11, 12 with a plurality of orifices so that it may be affixed by bolts 14 onto the stationary annular structure 2.

It will be understood that bolts 14 are used to connect the upstream end 11 and the downstream end 12 of two axially juxtaposed arcuate segments 7. This particular configuration acts as a seal between the juxtaposed rings 4*a*, 4*b*, 4*c* and runs perpendicularly to the outer sheetmetals 9.

As shown in the drawings, the upstream and downstream ends 11, 12 of the outer sheetmetal 9 bulge outward in order for the outer sheetmetal 9 and the rigid annular frame 2 to touch each other only as far as the upstream and downstream ends 11, 12 of the outer sheetmetal 9, whereby the conductive heat transfers between the outer sheetmetal 9 and the annular frame 2 shall be reduced as much as possible.

The honeycomb component 8, the outer sheetmetal 9 and the inner sheetmetal 10 are brazed to each other. The cross-section of the walls/partitions constituting the honeycomb component 8 is small so as to minimize conductive heat transfer through the honeycomb component 8 between the inner wall 10 and the outer wall 9. Moreover the walls/partitions constituting the honeycomb component 8, together with the outer and inner sheetmetals 9, 10, constitute a plurality of nearly sealed cavities which restrict air flow through the honeycomb component from downstream to upstream, and in turn, also restrict convective heat transfer between the inner sheetmetal 10 and the outer sheetmetal 9. The inner sheetmetal 10 outwardly bounds the hot-gas flow path 6, the gas being compressed by the compressor. Such gases are at elevated temperatures and the temperature of the inner wall 10 also is elevated.

Due to the honeycomb component 8 and to the space between the outer sheetmetal 9 and the annular frame 2 outside its upstream and downstream ends 11, 12, the conductive heat transfer between the inner sheetmetal 10 and the outer sheetmetal 9, and between the outer sheetmetal 9 and the annular frame 2 is considerably decreased.

The inner sheetmetal 10 therefore may freely expand without hampering the dynamic behavior of the arcuate segments 7. It will be understood that the upstream and downstream ends of the inner sheetmetals of adjacent sectors merely abut one another in order to constitute the outer wall of aerodynamic conduit of the hot gas flow path 6. The design is thus simplified because sealing elements are not required in these zones, the sealing of the annuli 7 being maintained by the honeycomb component 8 and by covering the upstream and downstream ends 11, 12 of the outer sheetmetals 9.

As shown in FIG. 2, the outer ends of the stationary vanes 5 are imbedded in appropriate orifices in the outer and inner sheetmetals 9, 10 and in the honeycomb component 8. The outer and inner sheetmetals 9 and 10 are rigidly connected by the honeycomb component 8 to each other and they are sufficiently apart from each other to restrict the stresses due to imbedding and to improve the mechanical damping of the stationary vanes 5.

Aligned orifices 15, 16, 17 may be fitted into the inner sheetmetal to tap an air flow F1, for instance to cool turbine blades/vanes.

The inside ends of the stationary vanes 5 of an arcuate segment 7 are affixed in conventional manner on a collar 18.

We claim:

1. An axial compressor stator for a gas turbine, including an outer, rigid, annular frame, axially juxtaposed rings which are configured inside the frame and which support annuli of stationary vanes, the rings having arcuate segments affixed to the frame, the inside walls of the segments externally defining the aerodynamic conduit for the compressed gas fluid, wherein the arcuate segments are brazed arcuate segments defined by a honeycomb component sandwiched between an inner sheetmetal bounding the aerodynamic conduit and an outer sheetmetal, the outer sheetmetal solely connecting the arcuate segments to the frame.

2. The compressor stator as claimed in claim 1, wherein the outer sheetmetal is affixed by a plurality of bolts to the frame.

3. The compressor stator as claimed in claim 2, wherein each outer sheetmetal is affixed by a plurality of bolts at its downstream end and at its upstream end to the frame.

4. The compressor stator as claimed in claim 3, wherein the outer sheetmetal is spaced apart from the frame outside is upstream ends and its downstream ends.

5. The compressor stator as claimed in claim 1, wherein the stationary vanes are imbedded into the inner sheetmetal and into the outer sheetmetal.

* * * * *